United States Patent [19]

Chang

[11] Patent Number: 5,031,733

[45] Date of Patent: Jul. 16, 1991

[54] SUITCASE CONVERTIBLE TO VEST

[76] Inventor: Kun-Ming Chang, No. 24, Lane 191, Sec. 4, San-Ho Rd., San-Chung City, Taiwan

[21] Appl. No.: 546,886

[22] Filed: Jul. 2, 1990

[30] Foreign Application Priority Data

Apr. 20, 1990 [TW] Taiwan ..... 79204181

[51] Int. Cl.[5] ..... A41D 15/04; A45C 9/00; A45F 4/00; F41H 1/02

[52] U.S. Cl. ..... 190/1; 2/2.5; 2/102; 383/4

[58] Field of Search ..... 383/4; 190/1, 107, 127, 190/900, 901; 150/900; 2/2.5, 94, 102; 294/138, 152; D2/184

[56] References Cited

U.S. PATENT DOCUMENTS

| | | | |
|---|---|---|---|
| 745,251 | 11/1903 | Sleght | 294/152 X |
| 841,902 | 1/1907 | Shumard | 294/152 X |
| 1,591,173 | 7/1926 | Mackey | 294/138 X |
| 1,739,112 | 12/1929 | Wisbrod | 2/102 X |
| 2,784,890 | 3/1957 | Chisholm | 294/152 |
| 3,848,267 | 11/1974 | De Spain | 2/94 |
| 4,475,247 | 10/1984 | Lee | 2/94 X |
| 4,483,469 | 11/1984 | Arisland | 190/107 X |
| 4,633,756 | 1/1987 | Rudoi | 2/2.5 X |
| 4,637,076 | 1/1987 | Tartt et al. | 190/107 X |
| 4,697,285 | 10/1987 | Sylvester | 2/2.5 |

FOREIGN PATENT DOCUMENTS

| | | | |
|---|---|---|---|
| 12334 | 6/1980 | European Pat. Off. | 190/1 |
| 2920455 | 11/1980 | Fed. Rep. of Germany | 190/1 |
| 457159 | 5/1950 | Italy | 190/1 |
| 18858 | of 1900 | United Kingdom | 150/900 |

*Primary Examiner*—Sue A. Weaver

*Attorney, Agent, or Firm*—Cushman, Darby & Cushman

[57] ABSTRACT

A suitcase with multiple hinged joints which allow it to unfold into a single plane and designed to be worn as a vest includes a first plate member, a second plate member and an elongated sheet member. The first plate member has a pair of two opposed edges, a first two opposed edges and a second two opposed edges. Each of the first two opposed edges has two straps. One edge of the second two opposed edges has a handle. The second plate member has a pair of two opposed edges, a first two opposed edges and a second two opposed edges. Each of the first two opposed edges has two straps, which are designed to engage and secure with the straps of the first two edges of the first plate member. One edge of the second two opposed edges of the second plate member has a handle which is aligned with the handle of the first plate member. The sheet member has two long edges and two short edges, the two long edges respectively connect the remaining edges of the second two opposed edges of the first and the second plate members.

7 Claims, 2 Drawing Sheets

SUITCASE CONVERTIBLE TO VEST

BACKGROUND OF THE INVENTION

The invention relates to a suitcase convertible to a vest, more particularly to a suitcase with multiple hinged edges which allow it to unfold into a single plane so that the suitcase may be worn as a vest. Normally, a suitcase is used for transporting things from one place to another, or for storing things. It is, therefore, common knowledge that a suitcase can not be worn as a vest. It is desirable to have a suitcase which can be adapted to serve as a vest comprising bullet-proof or non-bullet-proof material.

SUMMARY OF THE INVENTION

It is therefore the main object of the present invention to provide a suitcase having multiple hinged edges for unfolding the suitcase into a single plane for converting the suitcase to a vest.

Another object of the present invention is to provide a suitcase which not only can carry things, but which can also be utilized as a bullet-proof vest.

In accordance with the present invention, a suitcase comprises multiple hinged corners that allow the suitcase to unfold onto a single plane for wearing as vest, that vest being made of either bullet-proof material such as KEVLAR or non-bullet-proof material; first plate member; a second plate member; and an elongated sheet member.

The first plate member has two pair of opposed edges: a first pair of opposed edges and a second pair of opposed edges. Each edge of the first pair has two straps. The straps have a buckle with a pin pivotally attached thereto. One edge of the second pair has a handle.

The second plate member is identical to the first plate member. It has a pair of opposed edges: a first pair of opposed edges and a second pair of opposed edges. Each edge of the first pair of opposed edges on the second plate has two straps. The straps have a plurality of holes thereon. The straps of the first pair of opposed edges of the second plate are adapted to engage and be secured by the pins of the buckles of the first pair of opposed edges of the first plate member. One edge of the second pair of opposed edges of the second plate has a handle. The handle of the second plate is aligned with the handle of the first plate member.

The elongated sheet member has two long opposed edges and two short opposed edges. The two long opposed edges respectively connect the remaining edges of the second pair of edges of the first and second plate members.

BRIEF DESCRIPTION OF THE DRAWINGS

Other features and advantages of the present invention will become apparent from the following detailed description with reference in the accompanying drawings, in which.

DETAILED DESCRIPTION OF THE PREFERRED EMBODIMENT

Figure 1:
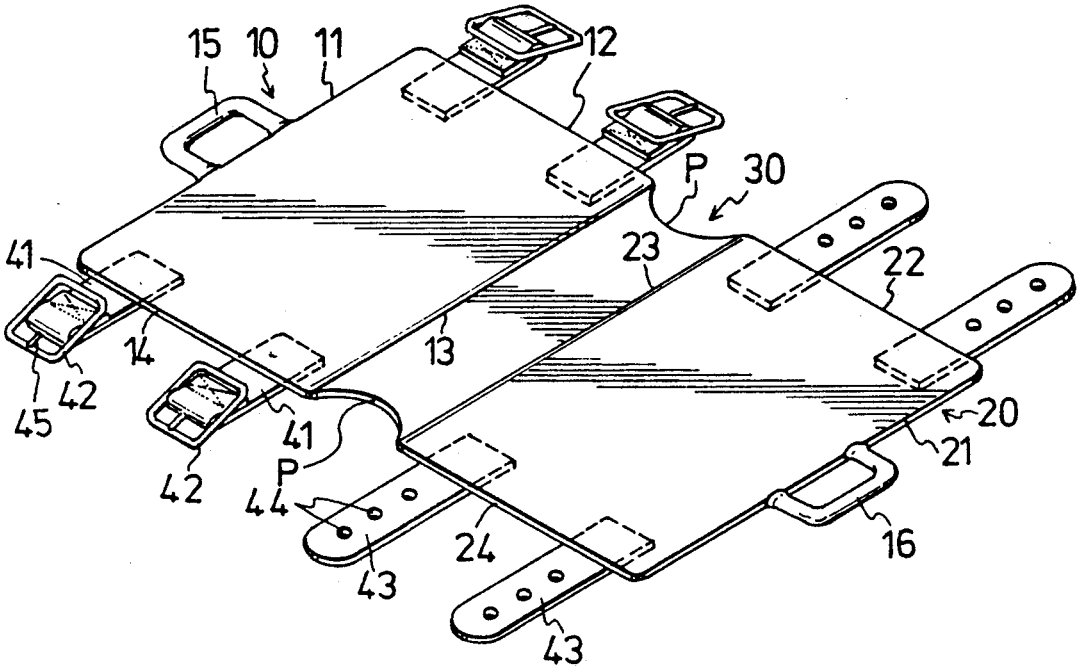
FIG. 1 depicts a suitcase of the present invention in a laid out position.
Figure 2:
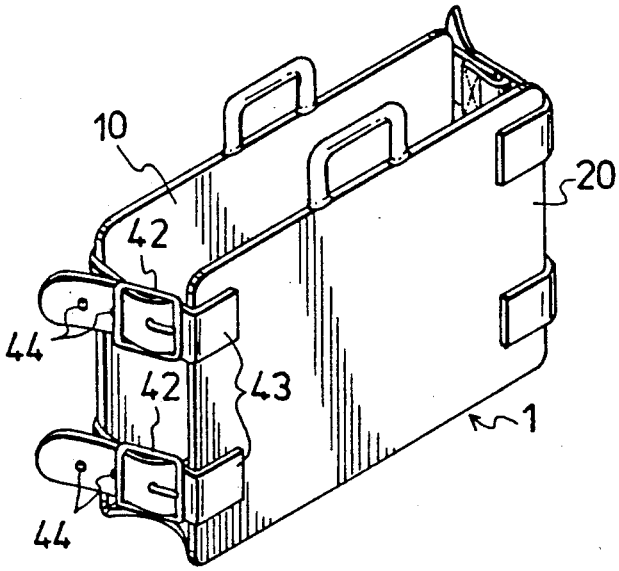
FIG. 2 shows a schematic view of a suitcase according to the present invention.

FIG. 2 shows a suitcase of the present invention. The suitcase 1 has multiple hinged straps that allow it to unfold into a single plane as shown in FIG. 1. The suitcase 1 had a first plate member 10, a second plate member 20 and an elongated sheet member 30. The first plate member 10 has two pairs of opposed edges: a first two opposed edges 12 and 14, and a second two opposed edges 11 and 13. Each of the first two opposed edges has two straps 41, and each of the straps 41 has a buckle 42 with a pin 45 pivotally attached thereto. One edge 11 of the second two opposed edges 11 and 13 has a handle 15.

The second plate member 20 is identical to the first plate member 10 and it has two pairs of opposed edges: a first two opposed edges 22 and 24 and a second two opposed edges 21 and 23. Each of the first two opposed edges 22 and 24 has two straps 43. Each of the straps 43 has a plurality of holes 44 thereon. As illustrated in FIG. 2, the straps 43 of the first two opposed edges 22 and 24 are adapted to engage and be secured by the pins 45 of the buckles 42 of the first two opposed edges of the first plate member 10. One edge 21 of the second two opposed plate member 20 is aligned with the handle 15 of the first plate member 10.

Figure 3:
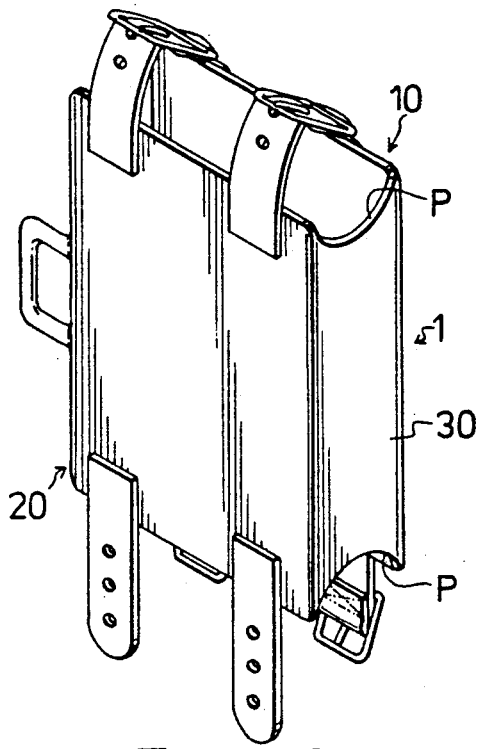
FIG. 3 shows a suitcase of the present invention adapted to be worn as a vest.
Figure 4:
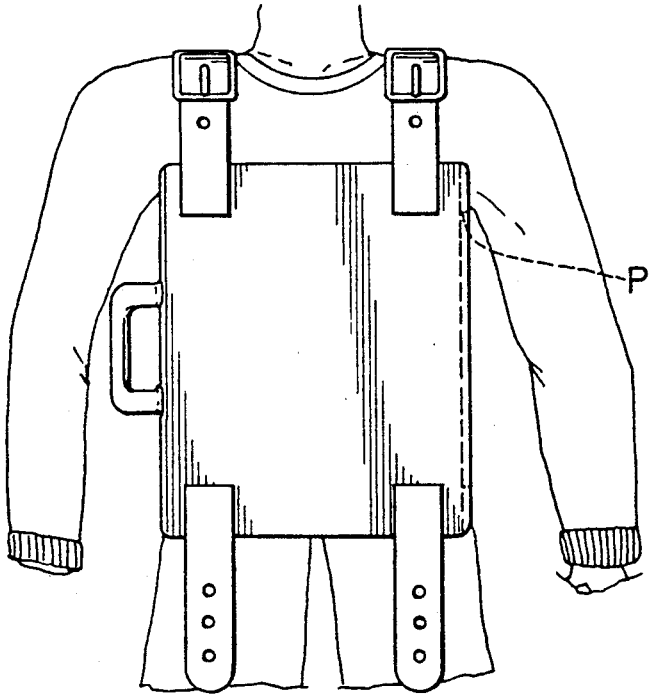
FIG. 4 shows a suitcase of the present invention being worn as a bullet-proof vest.

The elongated sheet member 30 has two long opposed edges 13, and 23, and two short opposed edges. The two short edges have shallow portions P in the middle so that human armpits can fit snugly therein when the suitcase 1 is worn as a vest, as best shown in FIGS. 3 and 4. The plate members 10 and 20 of the convertible vest-suitcase the present invention can be made of flexible bullet-proof material such as KELVAR so that such vest can also serve as a bullet-proof vest. The elongated sheet member 30 can also be made of bullet-proof material.

With the invention as explained above, it is obvious to those skilled in the art that several modifications and variations can be made without departing from the scope and spirit of the present invention. It is therefore intended that the invention be limited as indicated only in the appended claims.

I claim:

1. A suitcase having multiple hinged joints for unfolding the suitcase into a single plane and for converting the suitcase to a vest, comprising:

a first plate member having a first pair of opposed edges and a second pair of opposed edges, each edge of said first pair having two straps, and one edge of said second pair having a handle;

a second plate member identical to said first plate member, having a first pair of opposed edges and a second pair of opposed edges, each edge of the first pair having two straps including means for engaging with said straps of said first pair of edges of said first plate member, and one edge of said second pair of edges having a handle, said handle being aligned with said handle of second pair of edges of said first plate member; and, an elongted sheet member having two long opposed edges and two short opposed edges, said two long opposed edges respectively being connected to the remaining edges of said second pair of edges of said first plate member and of said second plate member by said hinged joints.

2. A suitcase as claimed in claim 1, wherein each of said straps of said first pair of opposed edges of said first plate member has a buckle with a pin pivotally.

3. A suitcase as claimed in claim 2, wherein said engaging means comprises a plurality of holes.

4. A suitcase as claimed in claim 3, wherein said straps of said first pair of opposed edges of said second plate member engage with said pins of said buckles of said first pair of opposed edges of said first plate member.

5. A suitcase as claimed in claim 1, wherein said first plate member and said second plate member comprise flexible, bullet-proof material.

6. A suitcase as claimed in claim 5, wherein said bullet-proof material is KEVLAR.

7. A suitcase as claimed in claim 6, wherein said suitcase serves as a bullet-proof vest when one edge of said first pair of opposed edges of said first plate member is engaged with the complementary edge of said first pair of opposed edges of said second plate member.

* * * * *